United States Patent [19]

Hartmann et al.

[11] Patent Number: 4,841,824

[45] Date of Patent: Jun. 27, 1989

[54] SAW CHAIN FOR A CHAIN SAW

[75] Inventors: Werner Hartmann, Ostfildern; Hans Dolata, Waiblingen; Jochen Buchholtz, Weinstadt, all of Fed. Rep. of Germany

[73] Assignee: Andreas Stihl, Waiblingen, Fed. Rep. of Germany

[21] Appl. No.: 211,220

[22] Filed: Jun. 21, 1988

[30] Foreign Application Priority Data

Feb. 18, 1988 [DE] Fed. Rep. of Germany ..... 3804954

[51] Int. Cl.[4] ..... B27B 17/00

[52] U.S. Cl. ..... 83/830; 83/835; 83/852

[58] Field of Search ..... 83/831, 832, 833, 834, 83/835, 839, 852; 76/112, DIG. 10; 407/118, 66, 67, 77, 101, 102; 72/379; 830/830

[56] References Cited

U.S. PATENT DOCUMENTS

| | | | |
|---|---|---|---|
| 1,872,240 | 8/1932 | Burnish | 228/139 |
| 2,976,900 | 3/1961 | Mills | 83/834 |
| 3,261,385 | 7/1966 | Cooper | 83/834 |
| 3,292,675 | 12/1966 | Bullard | 83/834 |
| 3,857,270 | 12/1974 | Iten | 72/379 |

FOREIGN PATENT DOCUMENTS

| | | | |
|---|---|---|---|
| 700203 | 12/1964 | Canada | 83/834 |
| 835995 | 6/1960 | United Kingdom | 407/66 |

*Primary Examiner*—Frank T. Yost
*Assistant Examiner*—Yu Chi Lin
*Attorney, Agent, or Firm*—Walter Ottesen

[57] ABSTRACT

A saw chain for motor-driven chain saws includes a cutting link which has three mutually adjacent supporting surfaces defining a U-shaped cutout for accommodating a hard metal insert in the form of a cutting plate therein. The support of the insert is provided at only subportions of these supporting surfaces and the remaining subportions provided an adequate spacing so that a solder gap is formed. The hard metal insert placed in this cutout has an adequate service time and does not require special equipment to hold the same during automatic soldering thereof into the cutting link.

8 Claims, 4 Drawing Sheets

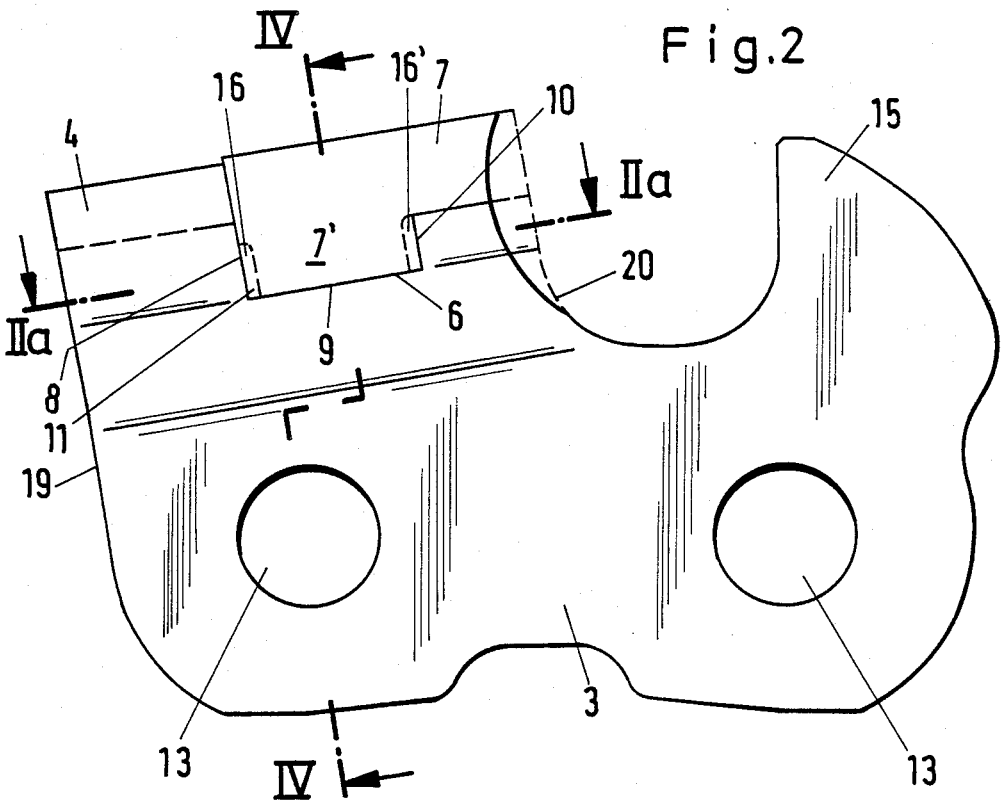
Fig.2
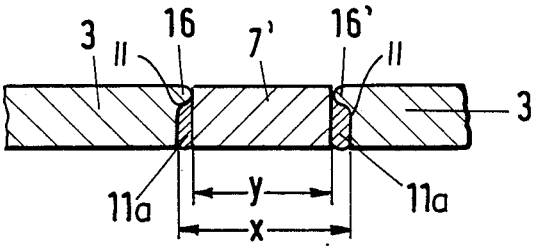
Fig.2a
Fig.3
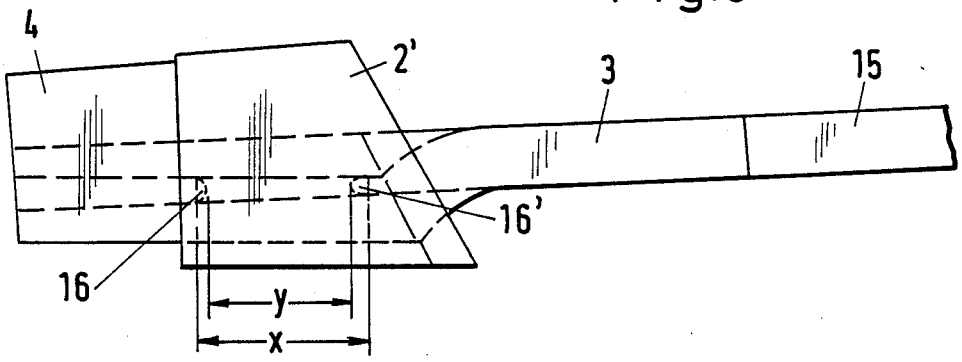

SAW CHAIN FOR A CHAIN SAW

FIELD OF THE INVENTION

A saw chain for a chain saw includes left-hand and right-hand cutting links, connecting links and drive links all pivotally interconnected by rivets or the like. Each of the cutting links includes a plate-like body having a rearward wall with an upwardly extending portion defining a cutout therein for accommodating an insert in the form of a cutting plate. The cutting plate is configured as a planing tooth made of wear-resistance hard metal. The planing tooth is soldered to a supporting surface formed on the upwardly extending portion of the rearward wall.

BACKGROUND OF THE INVENTION

German published patent application DE-OS 18 13 567 discloses a saw chain which includes a cutting plate seated in a recess open toward the front when viewed in the direction of movement of the saw chain. The cutting plate is made of hard metal or similar wear-resistant material and is attached to the recess by soldering. The cutting plate made of a high wear-resistant material is braced on a first supporting surface on the base body of the cutting link which lies in the direction of movement of the saw chain. The cutting plate is also braced against a rearward supporting surface lying preferably transverse to the first supporting surface. The cutting links are configured as planing teeth and are loaded by the cutting force which acts on the cutting edge as well as pressure forces which act in the longitudinal direction of the chain and transverse forces which, after a relatively short running time, provide a situation which can lead to a breakout of the hard soldered insert with the load on the soldering location being very substantial as a consequence of its small width and depth. This leads to a premature breakout in the presence of impact loading such as in a case of sawing branches which then causes the saw chain to be unusable for work because the particular cutting link must be exchanged or the entire saw chain must be replaced. The useful like of the high quality and expensive hard-metal inserts is not fully utilized as a consequence of the premature breakout so that the expensive and complex use of such wear-resistant inserts cannot be optimally utilized. Contributing to this disadvantage is that the hard-metal insert part does not have a complete form fit in the direction of movement of the chain and adequate solder gaps are not provided especially because of the pulled-down side portions of the hard-metal insert.

Published German patent application DE-OS 14 53 169 discloses a saw chain for rchain saws wherein the cutting teeth are made of hard-metal pieces soldered into the base body of the cutting tooth and which are seated in a form-tight manner in recesses of the base body of the cutting tooth so that they exclusively have a degree of freedom laying approximately perpendicular to the direction of movement of the chain. The inserted hard-metal plate is braced on a forward and a rearward supporting surface of the recess in the base body (viewed in the forward direction of movement) with the rearward supporting surface extending substantially transverse to the direction of movement. However, this saw chain is a pointed tooth chain wherein the cutting forces act essentially in the direction of movement so that no significant bending forces are transmitted as pressure forces into the even flat base body of the cutting link. Accordingly, the loading forces of such a pointed-tooth cutting link are substantially less than the cutting link configured as planing teeth for which the danger of the breakout of the hard-metal insert is less.

SUMMARY OF THE INVENTION

In view of the foregoing, it is an object of the invention to provide a saw chain of the kind described above which provides an increased useful life in comparison to the known saw chains equipped with hard-metal inserts. It is a further object of the invention to provide such a saw chain wherein the danger of a breakout of an insert is substantially prevented with the relatively brittle hard-metal insert is on the one hand so clamped into the base body that the danger of a bursting of the hard-metal cutting plate under the tension forces is eliminated and, on the other hand, the cutting plate has such a tight seat in the base body that an additional and complex holding for the hard-metal insert during the automatic soldering operation becomes unnecessary.

The saw chain according to the invention can be used with a chain saw having a guide bar. The saw chain includes a plurality of left-hand and right-hand cutting links and a plurality of connecting links, the links being pivotally interconnected by rivets to define the saw chain and to permit movement thereof along the guide bar in a predetermined direction. Each one of the cutting links includes a base body and an insert in the form of a cutting plate configured as a planing tooth made of wear-resistant metal. The base body has a cutout formed therein for seating the cutting plate. The cutout is defined by: a lower supporting surface formed on the base body so as to extend in the direction of movement of the saw chain and to define the bottom of the cutout; a rearward surface formed on the body so as to extend transversely to the lower supporting surface; and, a forward supporting surface approximately parallel to the rearward surface to complete the cutout and likewise extending transversely to the lower supporting surface. The cutting plate has a projection defined by a lower face for contact engaging the lower supporting surface and forward and rearward side faces adjacent corresponding ones of said forward and rearward supporting surfaces. The forward supporting surface includes a forward subregion and a forward remaining region; and, the rearward supporting surface includes a rearward subregion and a rearward remaining region. The forward face includes a forward subarea and a forward remaining area; and, the rearward face includes a rearward subarea and a rearward remaining area. The forward subregion and the forward subarea are configured to conjointly define a first clamping interface and the rearward subregion and the rearward subarea are configured to conjointly define a second clamping interface. There clamping interfaces effect a form-tight clamping of the insert in the base body. The forward remaining region and the forward remaining area conjointly define a first clearance adequate to define a first solder gap; and, the rearward remaining region and the rearward remaining area conjointly define a second solder gap.

Relatively small tension forces act on the brittle hard-metal cutting plate for the following reasons: the hard-metal cutting plate is tightly clamped in an approximately U-shaped output of the base body; the cutting plate is soldered into this cutout with an adequate soldering gap; and, the forward supporting surface of the cutout and the rearward surface of the cutout lying parallel to the forward supporting surface are so dimensioned and configured that the cutting plate is clamped in a form-tight manner between these surfaces only with respect subregions of the actual supporting surfaces. The cutting plate itself is nonetheless clamped into the base body in a form-tight manner such that an additional holding device is not required during automatic soldering of the cutting plate into the base body. The danger of developing a fissure or a bursting of the cutting plate is prevented by a reduction of the tension forces while, however, a still adequate tight clamping in the base body is assured. At the same time, the advantage is provided that the remaining subregions of the supporting surfaces which bound the cutout of the base plate and their counter surfaces on the cutting plate make possible an adequately large dimensioning of the solder gap between the cutting plate and the base body. In this way, a soldering gap is provided which can be fully utilized up to almost the thickness of the base body of the cutting link and the size of the clearance can be precisely dimensioned in correspondence to the required load relationships.

As a preferred embodiment which is at the same time simple to produce, the forward and rearward supporting surfaces of the cutout can be configured so as to extend conically with respect to each other so that the inserted cutting plate is tightly clamped only in the region of the smallest clear spacing of these supporting surfaces so that the conical clearance remaining over the thickness of the material of the base body can be fully utilized as a soldering gap. In this way, a soldering gap is provided which becomes ever larger at the actual narrow clamping location and which assures a flat and thereby secure soldering of the cutting plate into the base body of the cutting link. It is advantageous if the smallest spacing of the mutually adjacent supporting surfaces is displaced to an outer lying surface of the base body so that the entire remaining depth of the supporting surface with increasing width is available as a soldering gap.

The subregions of the forward and rearward supporting surfaces of the base body which effect the actual clamping can have any desired form. The uninterrupted narrow clamping surfaces are advantageous and can deviate from the edge form, strip form or linear form.

In a further embodiment of the invention, the supporting surfaces are formed as projecting clamping edges extending into the cutout. The width of these clamping edges is less than the width of the actual supporting surfaces. However, the cutting plate can also have slot-like recesses for receiving corresponding projecting parts of the supporting surfaces in a form-tight manner.

BRIEF DESCRIPTION OF THE DRAWINGS

FIG. 2 is a side elevation view of a cutting link of the saw chain of FIG. 1;

FIG. 2*a* is a section view taken along line II*a*—II*a* of FIG. 2;

FIG. 3 is a plan view of the cutting link of FIG. 2;

DESCRIPTION OF THE PREFERRED EMBODIMENTS OF THE INVENTION

Figure 1:
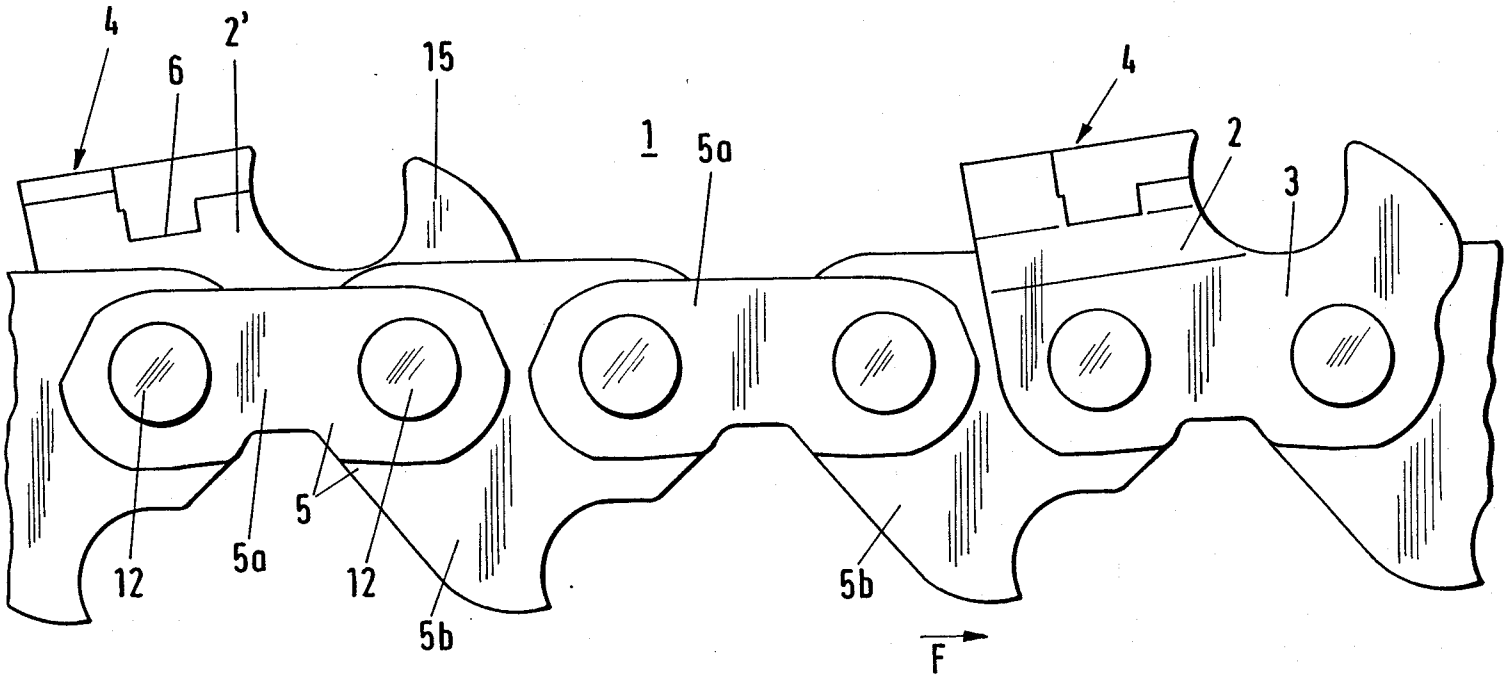
FIG. 1 is a side elevation view of a preferred embodiment of a saw chain according to the invention.
Figure 10:
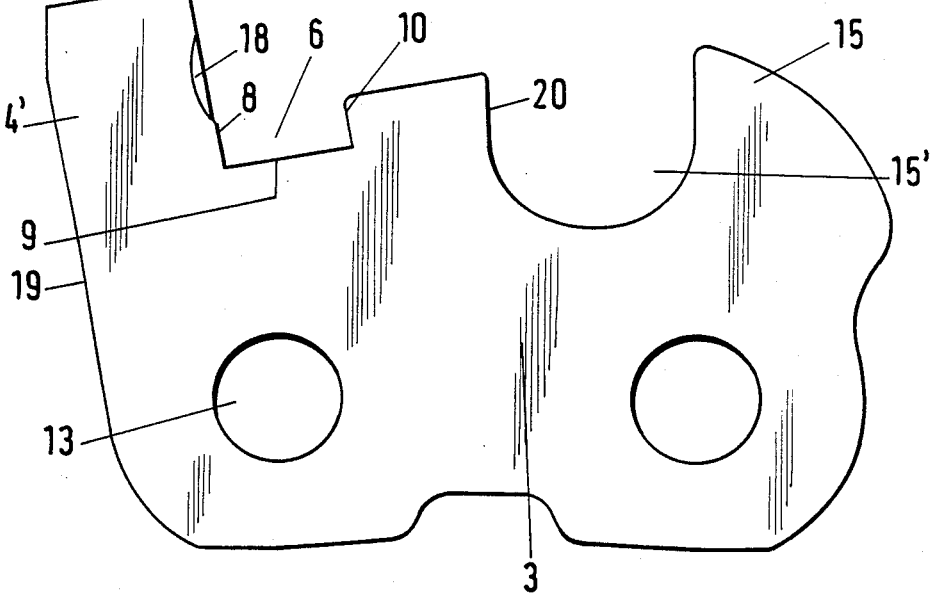
FIG. 10 is a punched plate of a cutting body without the cutting plate seated therein and showing the rearward roof portion which has not yet been bent over in a planing-tooth manner.

Referring to FIG. 1, the saw chain includes right-hand cutting links 2 and left-hand cutting links 2' which are pivotally connected with each other by means of spacing links 5 in the form of connecting links 5a, drive links 5b and pins or rivets 12. Each cutting link (4,4') has a base body 3 with an opening 13 for the connecting pins 12 (FIG. 2). The base body 3 is punched out as a blank from flat sheet metal and has the form shown in FIG. 10. Viewed in the direction of movement F, the base body has a forwardly disposed depth limiter 15, a gullet 15' directly next to the depth limiter 15 and a portion located in the region of the rearward rivet opening 13 in which the cutout 6 is provided for the cutting plate 7 to be inserted. The cutout 6 is bounded by the rearward support surface 8, the forward support surface 10 and the lower support surface 9 lying in the direction of movement of the saw chain. In addition, this portion of the base body is bounded by the forward edge 20 and the rearward edge 19 as shown in FIG. 10. A portion 4' which extends above the cutout 6 is located between the cutout 6 and the rearward bounding edge 19 of the cutting link. In the plate of FIG. 10, the portion 4' lies in the plane of the base body and forms a bent-over roof 4 of the cutting link (2, 2') in the finished cutting tooth (2, 2') and corresponds to the roof form of the hard-metal insert 7.

As shown in the drawing, the cutting links (2, 2') have a cutout 6 formed in the base body 3 which is approximately U-shaped in the embodiments shown and is bounded by the surfaces 8, 9 and 10. The cutting plate 7 made of hard metal or another highly wear-resistant material is seated in this cutout 6 and soldered. The cutting plate 7 is bent over to define a roof in correspondence to the rearward portion of the cutting tooth, that is, in the manner of a planing tooth. The lower portion 7' of the cutting plate 7 is adapted in its form and dimensions to the corresponding cutout 6 of the case body 3 as will be described in greater detail below.

Because of the U-shaped form of the cutout 6, the corresponding portion 7' is supported after soldering on: the rearward supporting surface 8, the lower supporting surface 9 lying in the direction of movement of the saw chain, and the forward supporting surface 10. Accordingly, the cutting plate 7 is seated in a form-tight manner in the base body in three directions, namely, in the direction of movement of the saw chain and the direction opposite to this movement as well as in a direction transverse to the base body. In this way, the pressure forces and transverse forces which act upon the cutting plate during cutting are optimally directed into the base body 3 of the cutting tooth (2, 2').

The forward supporting surface 10 and the rearward supporting surface 8 preferably lie parallel to each other and are dimensioned and configured so they effect a form-tight clamping of the cutting plate at only subregions of the supporting surfaces. These clamping subregions of supporting surfaces 8 and 10 which grip the cutting plate can be configured as bar-like segments. These bar-like segments are, however, at least arranged so as to be linear in such a manner that they extend parallel to the supporting surfaces 8 and 10.

In the embodiment of FIG. 2, 2*a* and 3, these subregions of the supporting surfaces are configured as projecting clamping edges (16, 16') which coact with counter surfaces of portion 7' of the cutting plate 7 such that the cutting plate 7 is clamped in a form-tight manner in the cutout 6 in the region of the clamping edges (16, 16'). The counter surfaces are adapted with respect to their dimensions and form to the projecting clamping edges (16, 16'). In this way, the clamping takes in only subregions of the actual supporting surfaces 8 and 10 such that the cutting plate 7 is not clamped in place with the entire thickness of these surfaces, that is, it is not clamped with the entire boundary surfaces in the manner of a press fit which would otherwise lead to a premature fracturing of the plate because of the brittleness of the highly wear-resistant material of which the cutting plate is made. The respective remaining regions of the supporting surfaces 8 and 10 and the corresponding counter surfaces of the cutting plate conjointly define an adequately large ga, 11 which is completely filled with solder 11*a* during the solder process and thereby form the soldering gap. In this connection, the difference between the measurements (x) and (y) in FIGS. 2*a* and 3 can be compared to obtain an appreciation of the soldering gaps which are formed.

Figure 4:
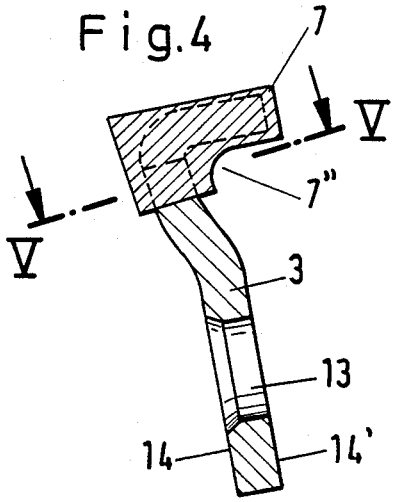
FIG. 4 is a section view taken along line IV—IV of FIG. 1.

As shown in FIGS. 3 and 4, the inserted hard-metal cutting plate 7 is likewise formed so as to have a roof-like configuration with an adequate space being provided by recess 7'' (see FIG. 4) for the removal of the chips.

The parallel and corresponding clamping edges (16, 16') shown in FIG. 2 are subregions of the supporting surfaces (8, 10) which effect a form-tight clamping of the cutting plate 7. In lieu of the clamping edges (16, 16'), these subregions can advantageously be obtained in that the rearward and the forward supporting surfaces (8 and 10) are configured so as to extend conically toward each other such that the inserted cutting plate 7 is tightly clamped and gripped only in the region of the narrowest spacing (a) of these supporting surfaces; whereas, the remaining and somewhat receding surface regions of the supporting surface 8 and 10 define an adequately large clearance which forms the solder gap 11. Thus, the solder gap here is formed in the same way as with the configuration of the remaining subregions of the supporting surfaces in the form of clamping edges.

Figure 5:
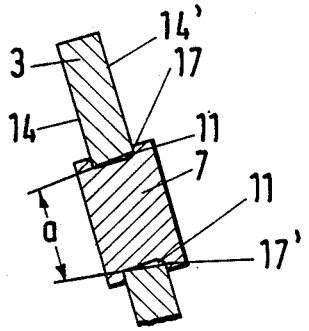
FIG. 5 is a section view taken along line V—V of FIG. 4.
Figure 7:
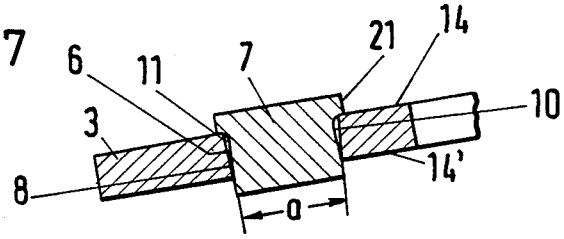
FIG. 7 is a section view taken along the line VII—VII of FIG. 6.
Figure 9:
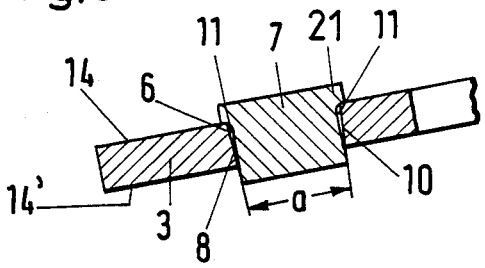
FIG. 9 is a section view taken along line IX—IX of FIG. 8.

The conical configuration of the supporting surfaces 8 and 10 is shown in section in FIGS. 5, 7 and 9. In this conical configuration, the cutting plate 7 is tightly held only in the region of the narrowest spacing between the conical supporting surfaces 8 and 10. This partial gripping of the plate 7 is so configured that the cutting plate is tight and yet is not rigidly gripped in the cutout 6. No special holding arrangement is required for the cutting plate 7 during the automatic soldering process. An adequate quantity of solder can penetrate into the sufficiently large solder gap 11 as a consequence of the capillary action occurring during the soldering process so that the solder gap is completely filled with solder and thereby provide a tight soldering in the region of the supporting surfaces 8 and 10 and in the region of the lower supporting surface 9 which extends in the direction of movement of the saw chain. As already mentioned, the clamping portions projecting into the cutout 6 have a width less than the width of the actual supporting surfaces 8 and 10 so that a targeted clamping of the cutting plate 7 is obtained in the region of these clamping portios. In the embodiment of FIGS. 2 and 2*a*, these clamping portions are the clamping edges 16, 16' and, in the embodiments of FIGS. 5, 7 and 9, the clamping edges are defined by the conically configured supporting surfaces 8, 10.

It is advantageous to place the cutout 6 approximately in the middle between the rearward limiting edge 19 and the forward limiting edge 20 of the base body 3 as shown especially in FIG. 10. In this way, the base body 3 receives the pressure and transverse forces which occur during cutting in a particularly uniform manner. A concave recess 18 is pressed out of the plate of the base body 3 shown in FIG. 10 to prevent the occurrence of buckling of the material in the region of the rearward support surface 8 or directly thereabove when the roof portion 4' is bent out of the planar stamped plate. The buckled material could otherwise affect the insertion or seating of the cutting plate 7. The buckled material can enter into the cutout 18 when the section 4' of the plate is bent to form the planing tooth-like roof 4.

Figure 6:
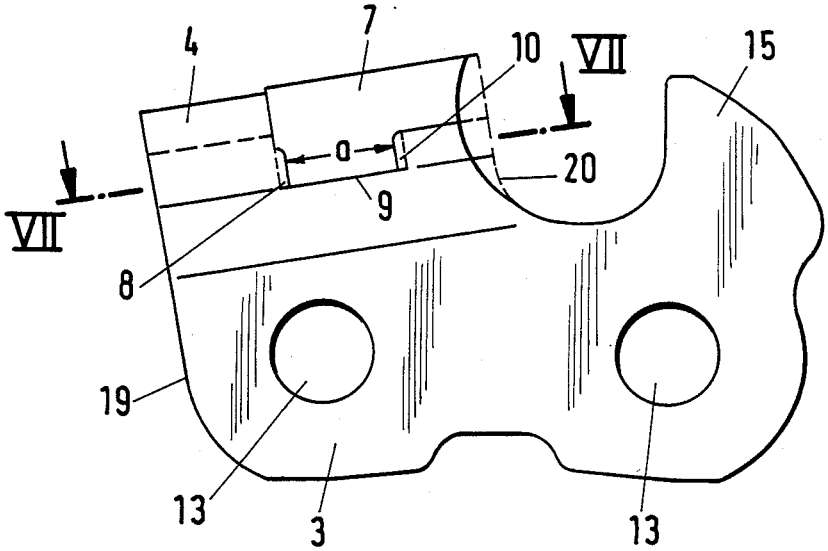
FIG. 6 is a side elevation view of a second embodiment of a cutting link according to a feature of the invention.

In the embodiment of FIGS. 6 and 7, the cutting plate 7 can be inserted into the recess 6 from the side of the base body, that is, perpendicularly to the surface of the base body 3. For this purpose, the cutting plate is provided with a stop 21 on one side thereof which limits the insertion by means of an abutting engagement on the side surface 14 of the base body 3. With respect to FIG. 7, it is noted that the supporting surfaces 8 and 9 extend conically in this embodiment also so that the cutting plate 7 is gripped in the region of the narrowest clearance. Reference numeral 11 identifies the solder gap which has adequate size and becomes increasingly wider.

Figure 8:
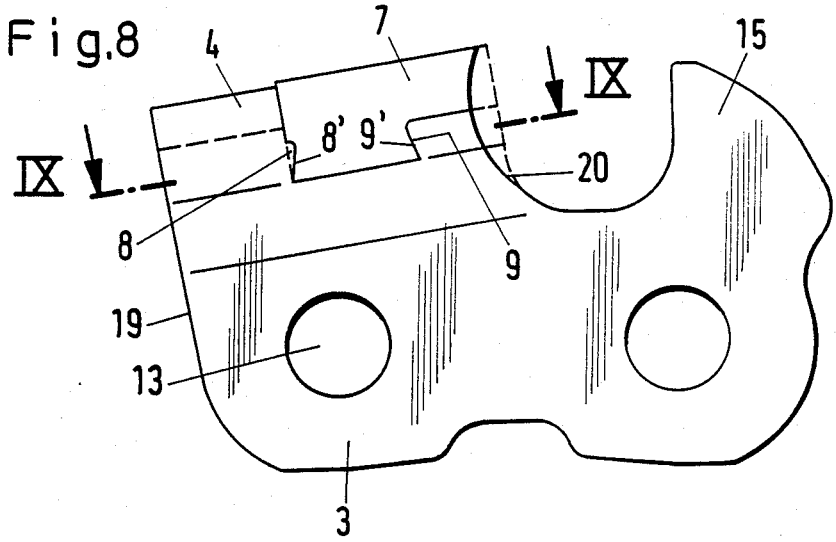
FIG. 8 is a side elevation view of a third embodiment of a cutting link according to a feature of the invention.

The embodiment of FIGS. 8 and 9 likewise show an insert 7 which is insertable from the side of the base body 3 into the cutout 6 and lies with a stop 21 against the side surface 14 of the base body 3. The clamping or gripping of the cutting plate 7 occurs in the same manner as with the embodiment of FIGS. 6 and 7 in the region of the smallest spacing (a) of the conically extending supporting surfaces 8 and 10, that is, on the side surface 14' of the base body 3 opposite the side 14. Here, too, the cutting plate 7 is so tightly clamped in the region of the mutually adjacent subregions of the supporting surfaces that no special holding means is required during automatic soldering and the soldering gap 11 is adequately large to ensure a tight and reliable soldering of the cutting plate 7 in the cutout 6.

FIG. 8 shows that in addition to the arrangement described above, the rearward supporting surface 8 and the forward supporting surface 9 are formed by the surfaces 8' and 9' because of respective undercuts such that the insert body (cutting plate 7) is additionally held in the base body 3 in the manner of a dovetail.

It is understood that the foregoing description is that of the preferred embodiments of the invention and that various changes and modifications may be made thereto without departing from the spirit and scope of the invention as defined in the appended claims.

What is claimed is:

1. A saw chain for a chain saw having a guide bar, the saw chain comprising:

a plurality of left-hand and right-hand cutting links and a plurality of connecting links, the links being pivotally interconnected by rivets or the like to define the saw chain and to permit movement thereof along the guide bar in a predetermined direction;

each one of said cutting links including a base body and an insert in the form of a cutting plate configured as a planing tooth made of wear-resistant metal;

said base body having an upper portion and said upper portion having a cutout formed therein for seating said cutting plate;

said cutout being defined by a lower supporting surface formed on said base body so as to extend in said direction of movement and to define the bottom of said cutout; a rearward surface formed on said body so as to extend transversely to said lower supporting surface; and a forward supporting surface approximately parallel to said rearward surface to complete said cutout and likewise extending transversely to said lower supporting surface;

said cutting plate having a downwardly extending projection defining a lower face for contact engaging said lower supporting surface and forward and rearward side faces adjacent corresponding ones of said forward and rearward supporting surfaces;

said forward supporting surface including a forward subregion and a forward remaining region; and, said rearward supporting surface including a rearward subregion and a rearward remaining region;

said forward side face including a forward subarea and a forward remaining area; and, said rearward side face including a rearward subarea and a rearward remaining area;

said forward subregion and said forward subarea being configured to conjointly define a first clamping interface and said rearward subregion and said rearward subarea being configured to conjointly define a second clamping interface;

said forward remaining region and said forward remaining area conjointly defining a first clearance adequate to define a first solder gap; and, said rearward remaining region and said rearward remaining area conjointly defining a second solder gap;

said clamping interfaces being dimensioned to effect a form-tight clamping fixation of said insert in said base body preparatory to a filling of said solder gaps with solder; and, solder disposed in said gaps to define respective solder joints for solder holding said insert in said base body.

2. The saw chain of claim 1, said base body having first and second flat sides extending in said direction, said forward and rearward supporting surfaces extending between said flat sides and being configured so as to lie in respective mutually inclined planes so as to cause said forward and rearward surfaces to define a first spacing therebetween which is less than the spacing therebetween at said second flat side; and, said forward subregion and said rearward subregion being disposed on said forward and rearward surfaces to conjointly define said first spacing; said forward remaining region and said forward remaining area conjointly defining said first solder gap as having a conical section and said rearward remaining region and said rearward remaining area likewise conjointly defining said second solder gap as having a conical section.

3. The saw chain of claim 2, said first spacing being at said first flat side.

4. The saw chain of claim 1, said forward subregion and said rearward subregion being configured as respective clamping projections extending into said cutout beyond corresponding ones of said remaining regions, said subregions having respective widths less than the respective widths of said forward and rearward supporting surfaces.

5. The saw chain of claim 1, said base body having forward and rearward edge portions defining said forward and rearward supporting surfaces, respectively; said forward face and said rearward face having a forward slot and a rearward slot formed therein, respectively; said forward slot having a forward base defining said forward subarea and said forward remaining area and said rearward slot having a base defining said rearward subarea and said rearward remaining area; said cutting plate being seated in said cutout so as to cause said forward edge portion to be seated in said forward slot to bring said forward subregion into clamping contact engagement with said forward subarea and so as to cause said rearward edge portion to be seated in said rearward slot to bring said rearward subregion into clamping contact engagement with said rearward subarea.

6. The saw chain of claim 1, said base body initially being a plate having an upwardly extending projection which is later bent over to form a planing tooth-like roof; and, said base body having a concave recess formed therein so as to be disposed above said rearward support surface.

7. The saw chain of claim 1, said insert having a forward end facing in said direction of movement; said base body having an upwardly extending rearward portion; said rearward portion having a leading edge at said forward end of said insert and a trailing edge defining the rearward periphery of said base body; and, said cutout being formed in approximately the center of said upwardly extending rearward portion.

8. The saw chain of claim 3, said cutting plate having a stop formed thereon so as to come into abutting engagement with said second flat side upon being inserted laterally into said cutout.

* * * * *

UNITED STATES PATENT AND TRADEMARK OFFICE

CERTIFICATE OF CORRECTION

PATENT NO. : 4,841,824

DATED : June 27, 1989

INVENTOR(S) : Werner Hartmann, Hans Dolata and Jochen Buchholtz

It is certified that error appears in the above-identified patent and that said Letters Patent is hereby corrected as shown below:

Title page:

In the Abstract, line 7: delete "provided" and substitute -- provide -- therefor.

In column 1, line 53: delete "rchain" and substitute -- chain -- therefor.

In column 1, line 58: delete "laying" and substitute -- lying -- therefor.

In column 2, line 3: delete "link" and substitute -- links -- therefor.

In column 2, line 57: delete "There" and substitute -- These -- therefor.

In column 2, line 67: delete "output" and substitute -- cutout -- therefor.

UNITED STATES PATENT AND TRADEMARK OFFICE

CERTIFICATE OF CORRECTION

PATENT NO. : 4,841,824

DATED : June 27, 1989

INVENTOR(S) : Werner Hartmann, Hans Dolata and Jochen Buchholtz

It is certified that error appears in the above-identified patent and that said Letters Patent is hereby corrected as shown below:

In column 3, line 6: delete "respect" and substitute -- respective -- therefor.

In column 3, line 30: the word between "smallest" and "spacing" should read -- clear --.

In column 4, line 54: delete "case" and substitute -- base -- therefor.

In column 5, line 30: the word between "large" and "11" should read -- gap --.

In column 5, line 52: delete "surface 8" and substitute -- surfaces 8 -- therefor.

Signed and Sealed this

Fifteenth Day of May, 1990

*Attest:*

HARRY F. MANBECK, JR.

*Attesting Officer*

*Commissioner of Patents and Trademarks*